US009261248B2

(12) United States Patent
Fournier et al.

(10) Patent No.: US 9,261,248 B2
(45) Date of Patent: Feb. 16, 2016

(54) BATTERY POWERED ELECTRONIC CANDLE WITH SPEAKER

(71) Applicant: Winvic Sales Inc., Markham (CA)

(72) Inventors: Bernard Fournier, Delson (CA); Carlos Carpintero, Delson (CA); John Bacher, Markham (CA); Kim McCavit, Benton Harbor, MI (US)

(73) Assignee: Winvic Sales Inc., Markham, Ontario (CA)

( * ) Notice: Subject to any disclaimer, the term of this patent is extended or adjusted under 35 U.S.C. 154(b) by 0 days.

(21) Appl. No.: 14/721,697

(22) Filed: May 26, 2015

(65) Prior Publication Data

US 2015/0252968 A1 Sep. 10, 2015

Related U.S. Application Data

(63) Continuation of application No. 14/055,403, filed on Oct. 16, 2013, now Pat. No. 9,039,233.

(51) Int. Cl.

| | |
|---|---|
| ***F21L 4/00*** | (2006.01) |
| ***F21V 33/00*** | (2006.01) |
| ***F21S 6/00*** | (2006.01) |
| *F21W 121/00* | (2006.01) |

(52) U.S. Cl.

CPC ..... *F21L 4/005* (2013.01); *F21S 6/001* (2013.01); *F21V 33/0056* (2013.01); *F21W 2121/00* (2013.01); *Y10S 362/81* (2013.01)

(58) Field of Classification Search

CPC ..... F21V 33/0056; F21S 6/001; Y10S 362/81
USPC ..... 362/810, 202, 205, 206, 253
See application file for complete search history.

(56) References Cited

U.S. PATENT DOCUMENTS

| | | | |
|---|---|---|---|
| 3,762,857 | A | 10/1973 | Andeweg |
| 5,174,645 | A | 12/1992 | Chung |
| 5,582,478 | A | 12/1996 | Ambrosino |
| 5,839,821 | A | 11/1998 | Lezotte |

(Continued)

FOREIGN PATENT DOCUMENTS

CN 202001854 U 10/2011

OTHER PUBLICATIONS

PCT Notification of Transmittal of the International Search Report and the Written Opinion of the International Searching Authority, or the Declaration in application No. PCT/IB2014/003271, dated Oct. 30, 2015 (9 pages).

*Primary Examiner* — Laura Tso
(74) *Attorney, Agent, or Firm* — McAndrews, Held & Malloy, Ltd.

(57) ABSTRACT

The present disclosure relates to an electronic candle with an electronic light source. The electronic candle has a candle body with an interior cavity. A removable battery module supplies power to the electronic candle and is removable from the interior cavity of the candle body. The electronic candle can have a base cap module for closing the interior cavity of the candle body and a speaker for generating sound. The speaker can be positioned between the battery module and the base cap module, and directed to project sound downward. Apertures in the battery module and/or the base cap module allow sound from the speaker to pass through the aperture or apertures into the interior cavity of the candle body. Accordingly, the candle body can resonate and/or amplify sound generated by the speaker.

15 Claims, 11 Drawing Sheets

(56) References Cited

U.S. PATENT DOCUMENTS

| | | | | |
|---|---|---|---|---|
| 5,921,767 | A | 7/1999 | Song | |
| 6,074,199 | A | 6/2000 | Song | |
| 6,877,878 | B2 | 4/2005 | Raskas | |
| 7,997,772 | B2 | 8/2011 | Avtzon et al. | |
| 2004/0160764 | A1 | 8/2004 | Lee | |
| 2005/0180148 | A1 | 8/2005 | Ham et al. | |
| 2007/0121319 | A1 | 5/2007 | Wolf et al. | |
| 2007/0297185 | A1 * | 12/2007 | Yu | F21S 19/00 362/392 |
| 2008/0117633 | A1 | 5/2008 | Li | |
| 2010/0156326 | A1 | 6/2010 | Chen | |

* cited by examiner

BATTERY POWERED ELECTRONIC CANDLE WITH SPEAKER

RELATED APPLICATIONS

This application is a continuation of U.S. application Ser. No. 14/055,403 filed Oct. 16, 2013, which is incorporated herein by reference in its entirety.

BACKGROUND

Electronic candles, or flameless candles, are used as safe aesthetic replacements for actual flame burning candles in many environments. Electronic candles can provide many or all of the visual benefits of an actual candle, without the dangers and mess that can result from the use of an actual flame. Moreover, unlike actual candles, electronic candles do not melt and burn down, and therefore, can go longer periods of time without being replaced.

Electronic candles can also be used to provide other utility. For example, electronic candles can incorporate microphones and cameras and be used to obtain photographs, videos, or audio recordings. Additionally, electronic candles can be used to generate and/or reproduce sounds, such as voices, music, or other pre-recorded sounds.

Adding functionality into electronic candles can pose problems, however, because the equipment involved in providing the added functionality can negatively impact, the internal operating components of the electronic candle. Internal components of the electronic candle, such as the light source (for example, the bulb), electrical wiring, and power sources (for example, batteries) can occupy limited space within the electronic candle, leaving little room for other equipment. For example, the internal components (for example, a battery or battery holder) can obstruct and inhibit an electronic candle's ability to produce and project sound at a reasonably satisfactory level of quality. Moreover, adding new functionality may involve restructuring the internal components of the electronic candle in a manner that results in a less efficient operation. For example, adding sound producing functionality to an electronic candle might involve adding internal components that obstruct the light source from view and result in a less realistic candle appearance.

SUMMARY

The present technology provides an electronic candle with an electronic light source. In some embodiments, the electronic candle includes a candle body with an interior cavity. The electronic candle can include a removable battery module configured to be installable in and/or removable from the interior cavity of the candle body. The battery module can supply electric power to the electronic candle. The battery module can comprise one or more battery holders that can hold batteries and distribute electrical power from the batteries to the electronic candle. In certain aspects, the electronic candle includes a base cap module configured to close the interior cavity of the candle body. The electronic candle of the present technology can also comprise a speaker for generating sound. The speaker can be positioned between the battery module and the base cap module so that the electronic candle projects sound toward a lower portion of the electronic candle. In certain embodiments, there are one or more apertures in the battery module, the base cap module, or other internal components of the electronic candle. The aperture(s) can allow sound from the speaker (for example, from the rear of the speaker) to pass into the interior cavity of the candle body. In this manner, the candle body can resonate and/or amplify sound generated by the speaker. That is, the candle body can serve as a resonating box for the speaker to amplify, enrich or otherwise improve the sound quality generated by the electronic candle.

In certain aspects, the present description provides a power unit for an electronic candle, where the electronic candle has a candle body. In some embodiments, the power unit comprises a battery module that is installable within an interior cavity of the candle body. The battery module can be operable to supply electric power to the electronic candle. Moreover, the battery module can comprise one or more battery holders (for example, for holding replaceable batteries). The power unit can also include an electronic light source positioned on an upper portion of the battery module. The electronic light source can be in electrical connection with the battery module. In certain aspects, the power module has a base cap module for closing the interior cavity of the candle body. The power module can also comprise a speaker positioned between the battery module and the base cap module. The speaker can be positioned so that the electronic candle projects sound toward a lower portion of the electronic candle. The power unit can be uninstalled from the candle body by twisting the base cap module to disengage the candle body, and, in some embodiments, the power unit can be installed in the candle body by twisting the base cap module to engage the candle body. In certain embodiments, the power unit has at least one aperture allowing sound from the speaker to pass through the aperture into the interior cavity of the candle body. For example, the base cap module and/or the battery module can comprise one or more apertures that allow sound to pass into the interior cavity of the candle body. In this manner, sound from the speaker (for example, sound from the rear of the speaker) can pass through the aperture into the interior cavity of the candle body so that the candle body can amplify sound generated by the speaker. That is, the candle body can serve as a resonating box for the speaker as a way to amplify, enrich or otherwise improve the sound quality generated by the electronic candle.

Certain embodiments of the present technology provide a battery powered display unit. The battery powered display unit can have a display unit body, where the display unit body has an interior cavity. The battery powered display unit can also include a removable power unit. In some aspects, the removable power unit comprises a battery module configured to be installable in the interior cavity of the display unit body. The removable power unit can supply electric power to the electronic candle. The battery module can also comprise one or more battery holders. The battery powered display unit can also include a base cap module configured to close the interior cavity, and a speaker. The speaker can be positioned between the battery module and the base cap module, and arranged to project sound downwards, or towards the base cap module, for example. The power unit can be uninstalled from the display unit body by twisting the base cap module to disengage the display unit body. The removable power unit can have at least one aperture that allows sound from the speaker (for example, the rear of the speaker) to pass into the interior cavity of the display unit body. For example, the base cap module and/or the battery module can comprise one or more apertures that allow speaker produced sound to pass into the interior cavity of the display unit body. In this way, the display unit body can serve as a resonating box for the speaker as a way to amplify, enrich or otherwise improve the sound quality generated by the electronic candle. In some aspects, the removable power unit has an electronic light source (for example, a light emitting diode ("LED")) in electrical connection with the battery module. The electronic light source can be positioned on an upper portion of the battery module, for example, so that the electronic light source can be seen through a concave upper portion of the display unit body when the removable power unit is installed in the battery powered display unit. In certain aspects, the battery powered display unit also comprises a sound recording microphone installed in the interior cavity of the display unit body, for example, in the base cap module of the removable power unit. The battery powered display unit can also include a printed circuit board for managing sound recorded and played by the battery powered display unit, and a memory storage mechanism for recording audio files for playback on the speaker. In some embodiments, the battery powered display unit comprises an interface, for example, on the base cap module that allows a management of recording and playback of sound via the button(s) on the interface.

DETAILED DESCRIPTION

Figure 1:
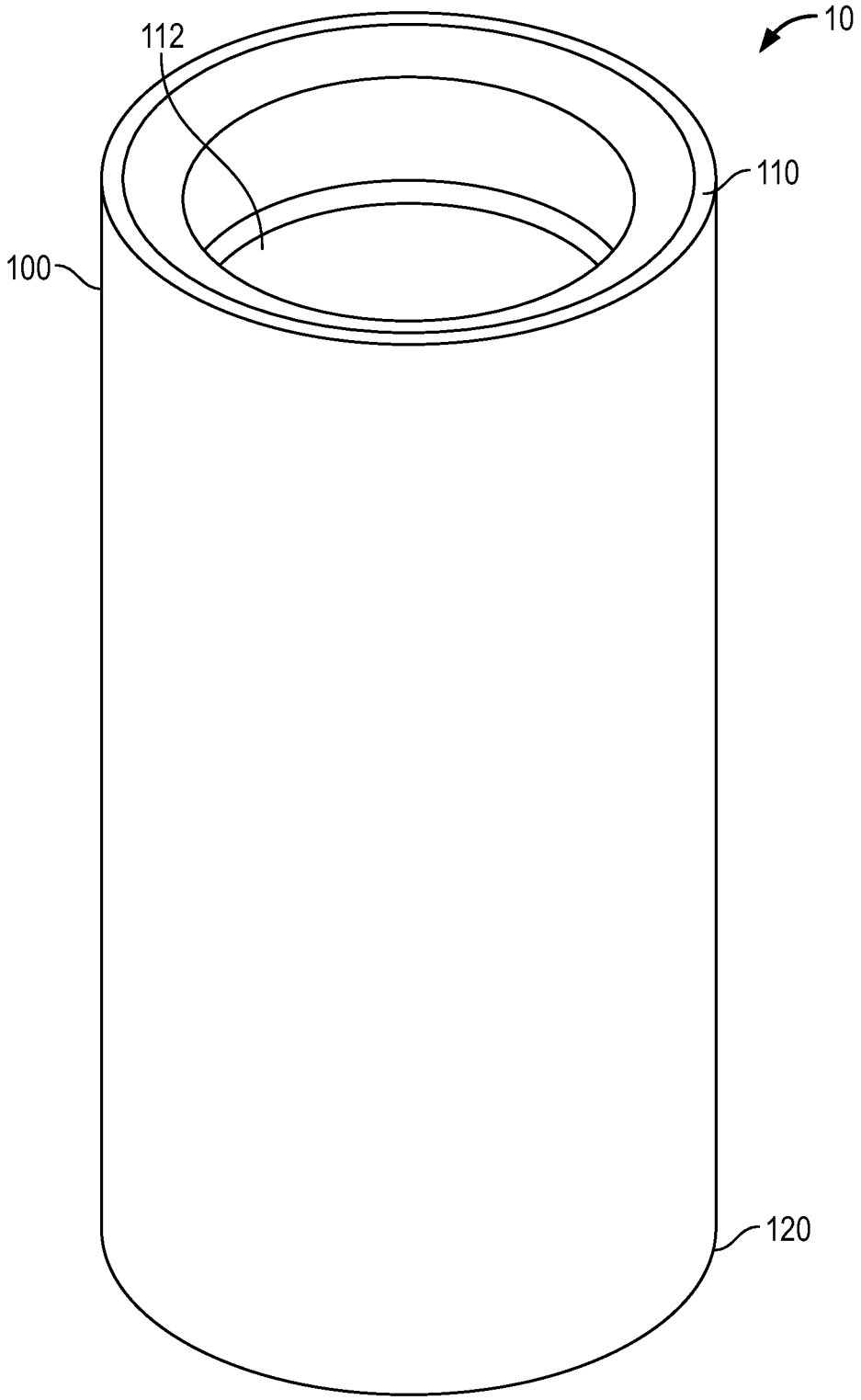
FIG. 1 shows an isometric view of an electronic candle in accordance with at least one embodiment of the present technology.

The present disclosure relates to electronic candles. More specifically, the present disclosure relates to battery powered electronic candles having speakers that generate sound. Various aspects of the present disclosure provide systems and methods that provide an electronic candle that can generate quality sound while also providing a user with efficient access to the candle batteries. In this way, a user can access, install, replace, and or repair the batteries or internal components of the electronic candle, without having to dismantle the electronic candle, and without negatively affecting the candle's visual or auditory performance.

In order to maintain the appearance of a candle, electronic candles may utilize a replaceable power source, such as replaceable batteries, as an internal component to the candle. The batteries can be installed in the electronic candle in a compartment, for example, that is wired to deliver electrical power to the candle. For example, the electronic candle may have a battery compartment can be electrically connected to a light source (for example, an LED, an incandescent bulb, a halogen bulb, or the like) that can generate a light and simulate the appearance of an actual candle.

Because electronic candles can operate longer than the life of a set of batteries, electronic candles can be designed with battery compartments that are readily accessible to a user. Further, to maintain an appearance of an actual candle, electronic candles can have interior battery compartments that are accessible on a candle surface that is hidden or obstructed from view when the candle is on display. For example, an electronic candle may have a battery compartment on the bottom of the candle, whereby a user can turn the candle over and access the battery compartment by removing or displacing a battery compartment cover.

In order to maintain a visually authentic candle appearance, sound producing electronic candles can be designed to project sound downwards in order to hide or disguise the sound projecting speaker surface of the candle. However, this can pose problems, because one or more batteries or a battery holder on the underside of the candle can obstruct the sound. Accordingly, batteries and/or a battery compartment located at the bottom of a sound producing electronic candle may result in a reduced sound quality.

For at least these reasons the present technology provides a battery compartment, or battery holder inside of the electronic candle at a position above the sound producing speaker. According to this arrangement, when the speaker is oriented to project sound primarily downwardly, the batteries or battery holder are not in the primary path of the sound emanating from the speaker. The present technology provides the battery holder as a part of a battery module, that, in turn, can be a part of a power unit, that can be readily and easily removed from the electronic candle, for example, via a twist and lock feature.

Moreover, a sound producing electronic candle can benefit from improved sound quality if the sound is amplified by a sound resonating mechanism, such as a speaker resonator. In this manner, it can be effective to use the body of the electronic candle to resonate and/or amplify the sound generated by the speaker. For example, the inside of the electronic candle (or the interior cavity) can serve as a "speaker box," sound resonator, or amplifier. However, in such an embodiment, components such as batteries, battery holders, electrical wiring, and other electronic candle components can obstruct the speaker sound from entering into the body cavity, thereby limiting the acoustical benefits of the sound resonator.

In some embodiments of the present technology, sound and/or sounds entering the base cap module from the front of the speaker (for example, sound projected outward from the candle) can be substantially isolated from sound and or sounds entering the interior cavity of the candle from the rear of the speaker. This isolation can inhibit and/or prevent the two sounds from mixing and/or cancellation, thereby resulting in an improved low-frequency fidelity.

A sound producing electronic candle can benefit from an improved sound quality if sound (i.e., sound waves) from the rear of a speaker are isolated from sound (i.e., sound waves) originating from the front side of the speaker. That is because sound waves from the rear of the speaker can interfere with, and/or cancel sound waves from the front of the speaker. However, in an electronic candle (or any other electronically driven apparatus), components such as batteries, battery holders, electrical wiring, and other electronic candle components can obstruct the sound waves from the rear of the speaker from entering into the body cavity, thereby limiting the acoustical benefits of isolating the front and rear sound waves.

For these reasons the present technology provides a power unit that has one or more apertures, allowing sound from the speaker to enter into the cavity of the candle body, so that the candle body can act as a resonator or amplifier, and provide isolation between sounds from the front and rear of the speaker. For example, the power unit may comprise one or more apertures in a base cap module, a battery module, or other structure of the power unit to allow sound from the speaker (for example, the rear of the speaker) to pass into the interior cavity of the candle body. In this manner, the candle body can resonate and/or amplify the sound, and isolate the front and rear produced sound waves, which can result in the electronic candle generating a louder, richer, cleaner, and generally more pleasing sound.

FIGS. 1-10 provide embodiments of electronic candles and the internal structures of electronic candles in accordance with one or more embodiments of the present technology. FIG. 1 shows an isometric view of an electronic candle 10. As shown, candle 10 comprises a candle body 100 having an upper portion 110 and a lower portion 120. In some embodiments, the candle body has a concave portion 112 at or near the upper portion 110 of the body 100. In this manner, the concave portion 112 can be designed to emulate the upper surface an actual candle, for example, a candle that has had a portion of the interior candle wax melted away. In some embodiments, the candle body 100 can comprise a wick, or a fake wick in the concave portion 112 of the candle body 100 to simulate the appearance of a real candle. In operation, an electronic light source, can be positioned within or below the concave top portion 112 of the candle body 100.

The candle body 100 can be made of a wax material, a plastic material, or another material. In some embodiments, the candle body 100 can be translucent so that a light source, when located within the candle body 100, can be visible to a user when the light source is illuminated. For example, the upper portion 110 of the candle body 100 can be translucent so that a light source located within the candle body 100 simulates the appearance of an actual candle when the light source generates light.

Figure 2:
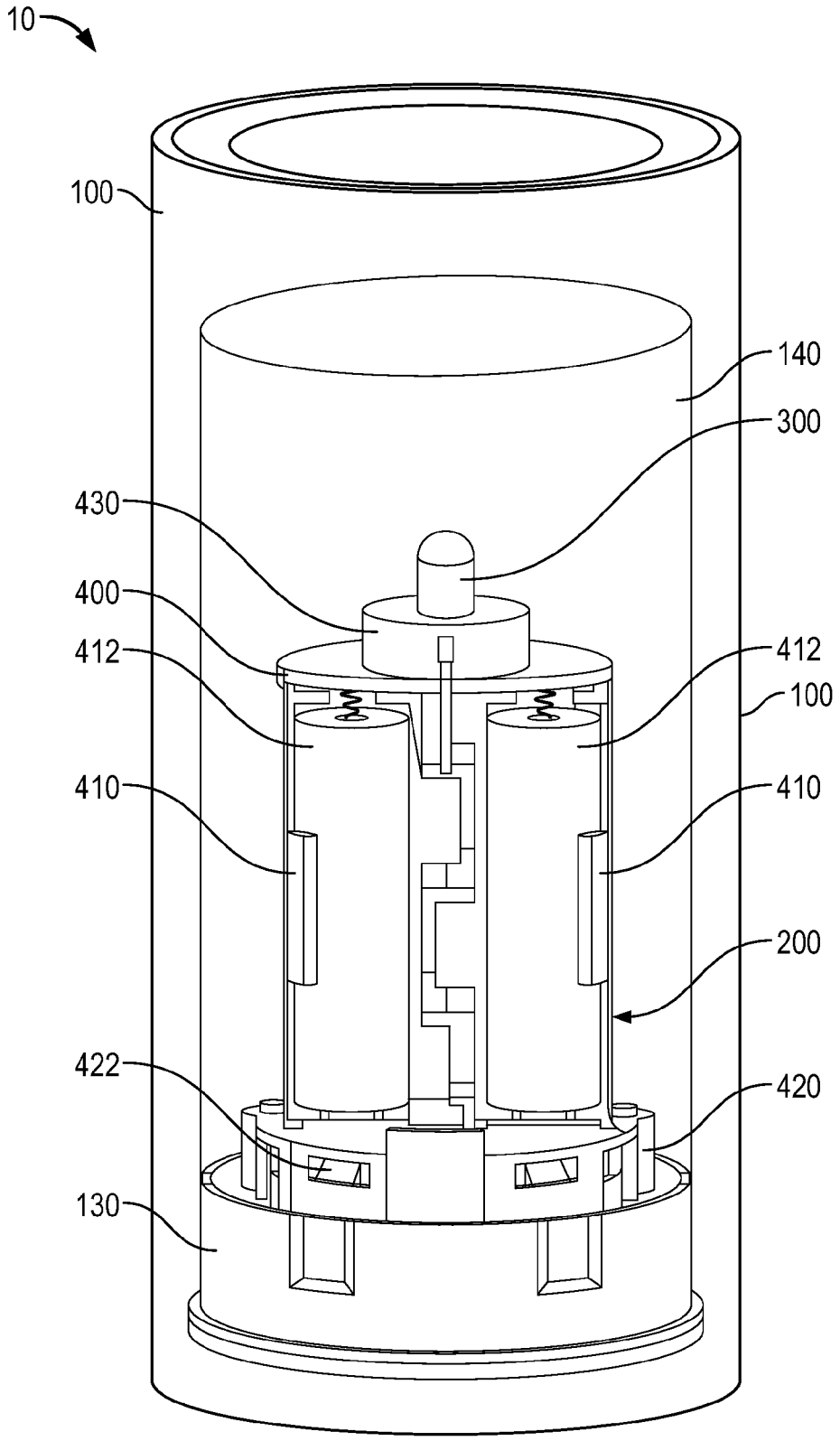
FIG. 2 is a front view of an electronic candle having a transparent candle body to show the internal structure of the electronic candle in accordance with at least one embodiment of the present technology.

In some embodiments, the candle body 100 is configured to produce a glowing effect when a light source located within the candle body 100 generates light. The candle body 100 can be hollow, establishing an interior cavity as shown in FIG. 2. In some embodiments, the candle body 100 can be made of wax, plastic, ceramic or glass. In some embodiments, the candle body 100 is formed to have a volume of air that resonates with the sound waves produced by the speaker.

FIG. 2 shows the internal structure of electronic candle 10 according to embodiments of the present technology. The electronic candle 10 has a candle body 100 which has been ghosted, or made to appear more transparent in order to show the internal structure of the candle 10. The candle body 100 can include a mounting ring 130 at the lower portion 120 of the candle body 100 that can connect with a removable power unit 200. For example, the mounting ring 130 can comprise mating components that are adapted to attach the candle body 100 with corresponding mating components on the removable power unit 200. In some embodiments, the mounting ring 130 comprises bayonet mating components adapted to mate with the removable power unit 200 via a bayonet style connection. That is, the mounting ring and the removable power unit 200 can be configured so that the power unit can be inserted, and then twisted to lock and/or fix into place, for example. The base cap module can be connected to the candle body via a number of other connection methods. For example, in some embodiments, the base cap module can be connected to the candle body with one or more screws, magnets, tabs, snap fit connectors, or via a threaded connection.

The interior portion of the candle body 100 forms an interior cavity 140, where the removable power unit 200 can be positioned. The removable power unit 200 is shown in further detail in FIG. 3, which shows a front view of the power unit 200, and in FIG. 4, which shows an exploded view of a power unit 200 in accordance with at least one embodiment of the present technology. In some embodiments, the power module comprises a battery module 400, a speaker 500 and a base cap module 600. The power unit 200 can be removable from, and installed (that is, placed in a position ready for use) within the candle body 100.

The terms "installed" and/or "installable," as used throughout this specification, are not intended to suggest that an object is permanently fixed, or unrecoverable. Rather, the term "installed" is intended to refer to something placed in position ready for use. For example, batteries are "installed" when placed in a position ready to delivery power to the electronic candle. Similarly, the power unit can be "installed" when it is placed in the electronic candle in a position to properly operate its function within the candle.

As shown in FIGS. 2-5, the removable power unit 200 can comprise an electronic light source 300, which can be, for example, an LED, or another kind of light source. The electronic light source 300 can be operated to simulate the appearance of a candle flame. For example, the electronic light source 300 may flicker, blink, or twinkle to simulate the visual appearance a candle. In some embodiments, the electronic candle 10 comprises one or more circuit boards or circuits (for example, circuits 710 and 720) or control modules that execute a flickering or other lighting program. In some embodiments, the flickering program can be controlled within the electronic light source 300, for example, by flickering circuits connected to the electronic light source 300. The flickering and/or lighting program can causes the light source 300 to flicker in a manner that simulates a candle flame. The electronic light source 300 can run on electrical power, for example, power provided by removable batteries. In some embodiments, the electronic candle 10 can be designed such that the electronic light source 300 is located within the candle body 100 when in use. Additionally and/or alternatively, the electronic light source can be located on the exterior of the candle body, for example.

Figure 6:
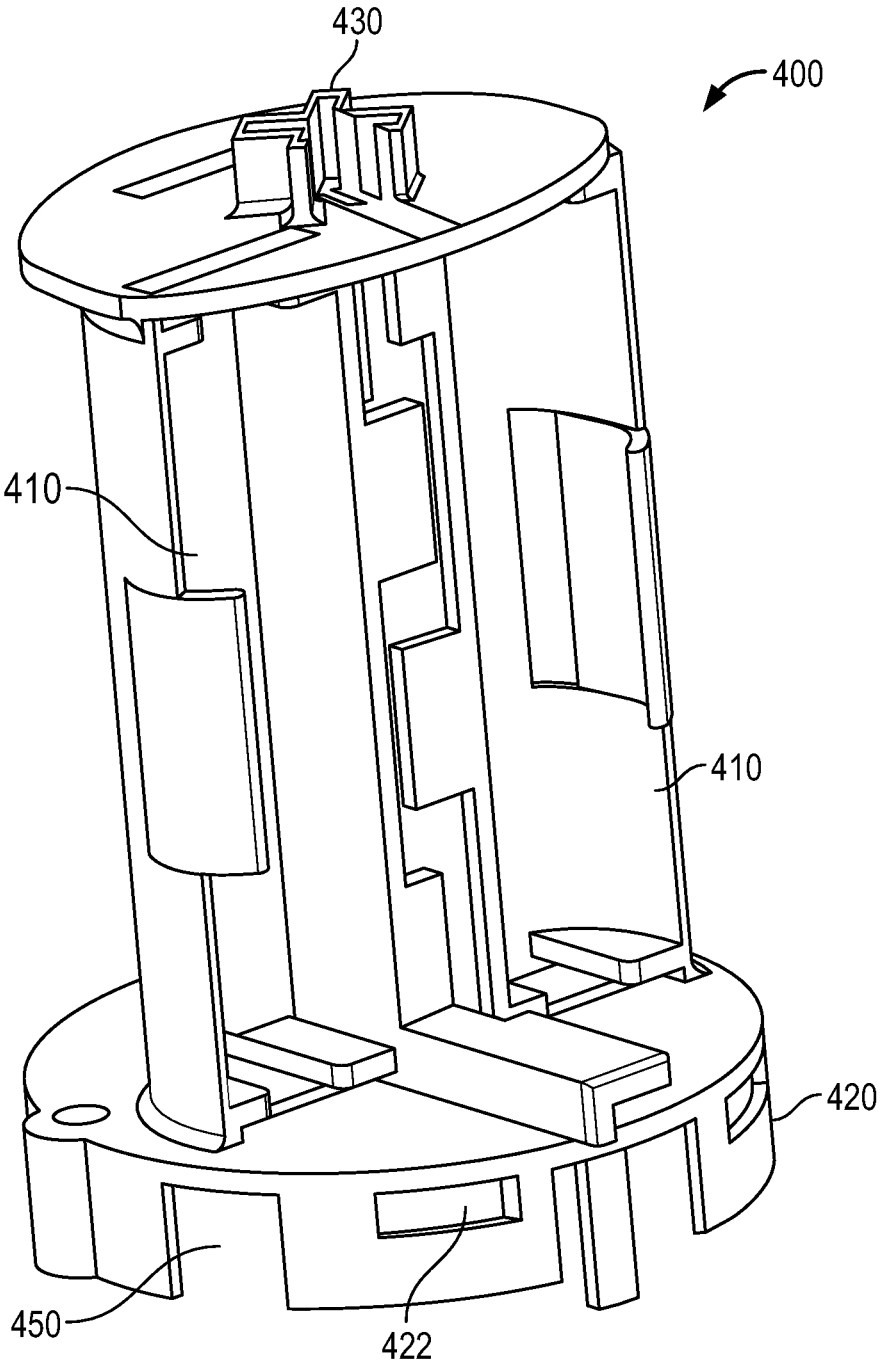
FIG. 6 shows an isometric view of a battery module for use with an electronic candle in accordance with at least one embodiment of the present technology.

The power unit 200 also comprises a battery module 400. FIG. 6 shows an isometric view of the battery module 400 separate from the other components of the power unit 200. As shown in the figures, the battery module 400 can hold batteries 412 and distribute electricity, or electric power to and throughout the electronic candle 10. For example, the battery module 400 can be used to supply electric power to the light source 300, to a speaker 500 or sound generating system, to a recording system, or to a light source flickering program processor. When batteries are installed in the battery module 400, it can be operable to supply electric power to and/or throughout the electronic candle 10.

Figure 3:
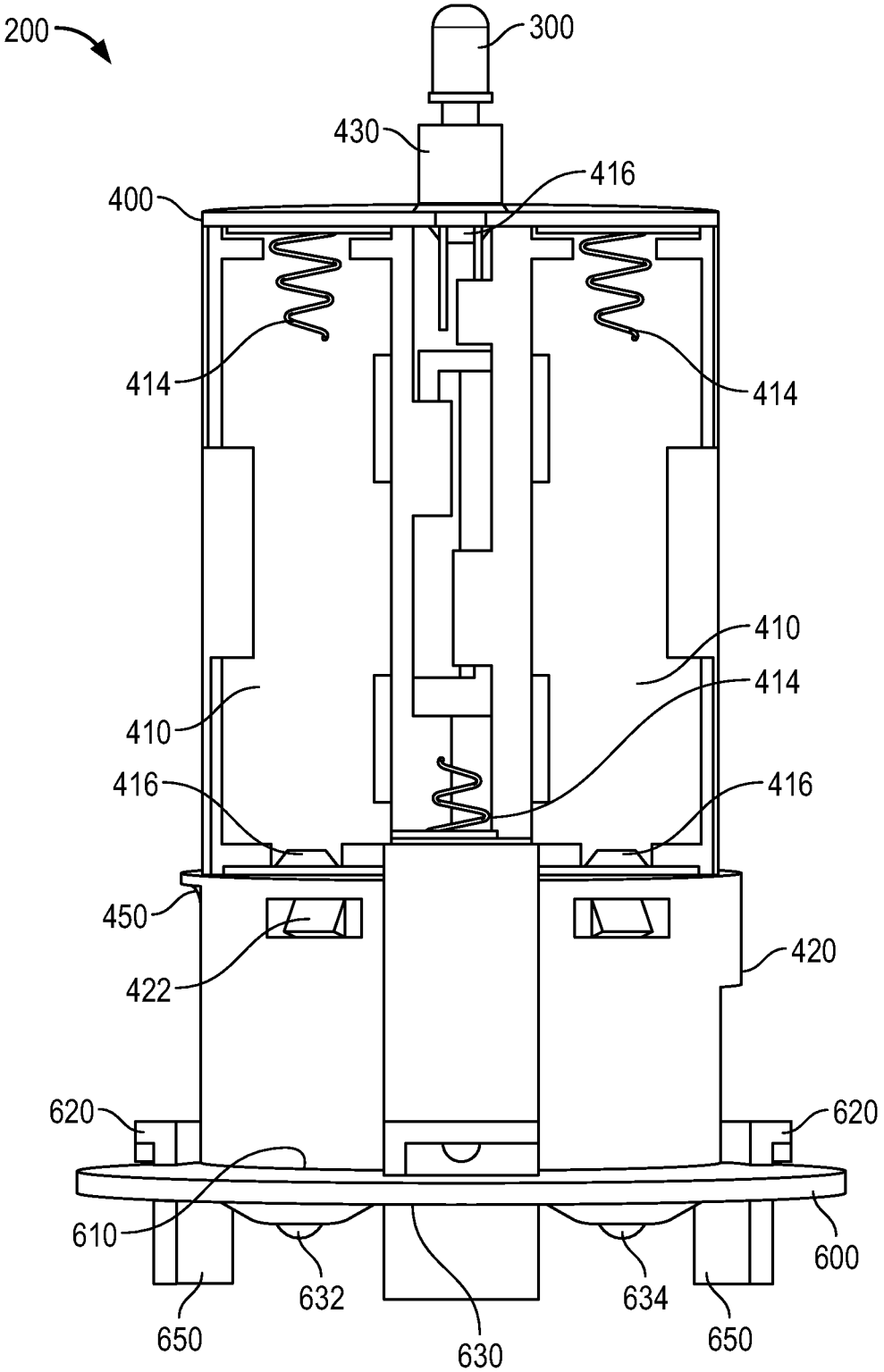
FIG. 3 shows a front view of a removable power unit for use with an electronic candle in accordance with at least one embodiment of the present technology.
Figure 4:
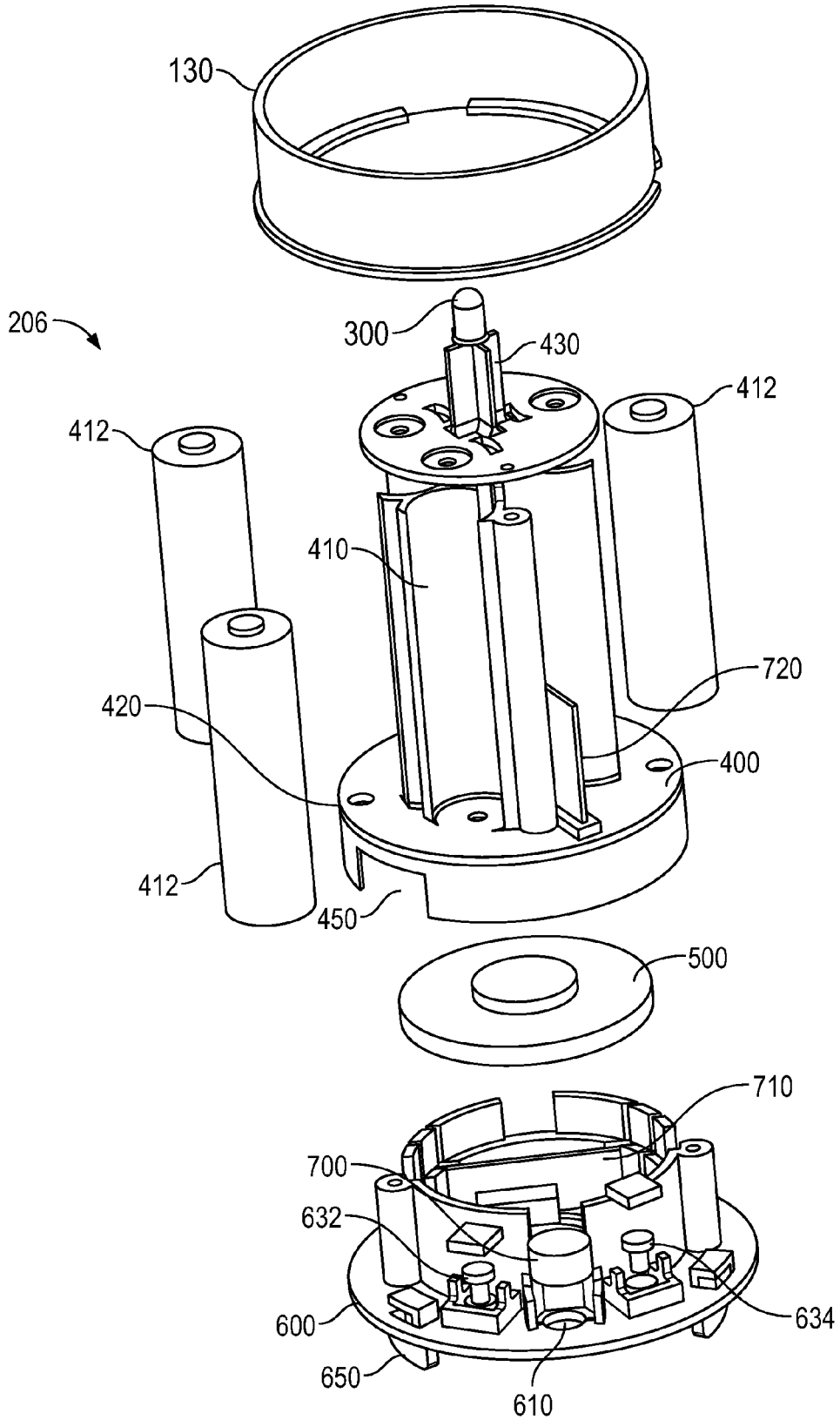
FIG. 4 shows an exploded view of a removable power unit for use with an electronic candle in accordance with at least one embodiment of the present technology.
Figure 5:
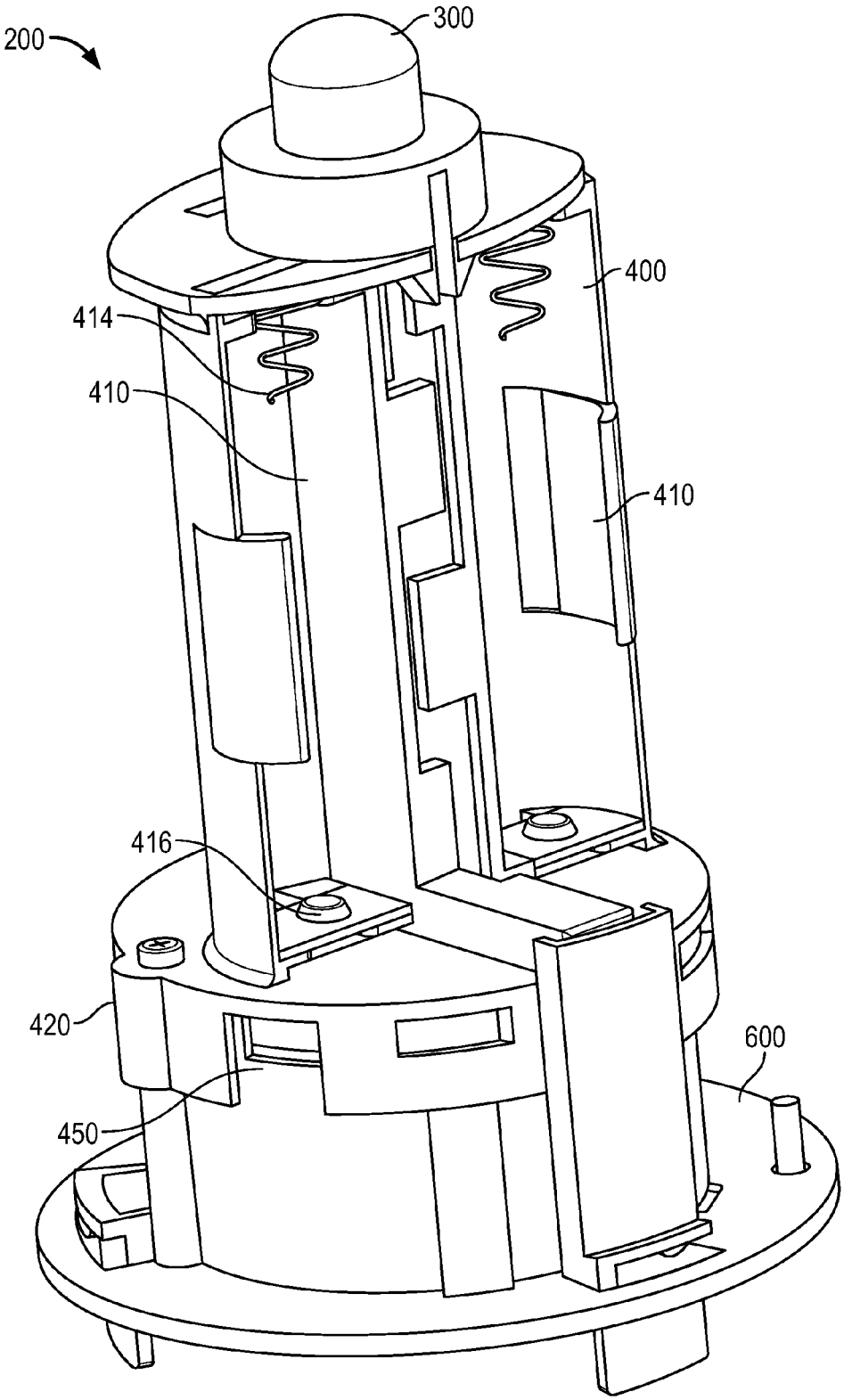
FIG. 5 shows an isometric view of a removable power unit for use with an electronic candle in accordance with at least one embodiment of the present technology.

The battery module 400 can include one or more battery holders 410, or battery compartments. The battery module of FIG. 6, for example, comprises three battery holders 410, with two battery holders 410 visible, and a third battery holder 410 on an opposite face of the battery module 400. The battery holders 410 can comprise negative battery contacts 414 and positive battery contacts 416, which can establish electronic circuits to harness and utilize power supplied by the batteries 412. FIG. 2 shows the battery holders 410 with batteries 412 installed in the holders 410, and FIG. 4 shows the batteries 412 removed from the battery holders 410. FIGS. 3, 5, and 6 show the battery holders 410 without batteries 412 in place. In some embodiments, the battery holders 410 are adapted to hold cylindrical batteries, such as standard AA or AAA sized batteries. Additionally and/or alternatively, depending on the size, shape, and power demands of the electronic candle 10, the battery holders 410 can be configured to hold other battery shapes sizes, for example, size C or D batteries, 9-volt batteries, or other smaller watch-sized batteries (for example, CR2032). Moreover, depending on the size, shape, and power demand of the electronic candle 10, the battery module 400 may comprise a varying number of battery holders 410, for example, one, two, three, four, or six battery holders 410.

In some embodiments the battery module 400 can be adapted to hold rechargeable batteries. In this manner, the battery module can be configured to recharge the batteries 412, or provide electric power to the batteries 412, when the battery module 400 and/or the electronic candle 10 is connected to another power source. For example, the electronic candle may comprise an electric charging device, such as an AC adaptor, that provides electric power from an AC power source into the battery module 400 so that the batteries 412 can receive a charge. In some embodiments, the electronic candle 10 can have a cordless charging adaptor on a surface of the candle. For example, the bottom surface of the candle can comprise a charging surface adapted to connect with a charging mat or other charging device or charging station. In this manner, the electronic candle 10 can be placed on the charging station or charging device to charge the batteries 412, without requiring the use of an attached power cord, or power cord adaptor in a visible location on the candle.

The battery module 400 can also comprise a platform 430, upon which the electronic light source 300 can be positioned or installed. In some embodiments, the platform 430 can also comprise electric circuitry that can deliver electric power to the light source 300, for example, from batteries 412 located in the battery module 410.

In some embodiments, the battery module 400 comprises a lower portion 420, which can define a cylindrical space to house a speaker 500, for example. The lower portion 420 can comprise mating components 422 that help attach the battery module 400 to the power unit 200. For example, the mating components 422 can be slots adapted to operate with tabs that protrude from a base cap module 600 of the power unit 200. In some embodiments, the battery module 400 can be attached or mounted to the power unit 200 via screws or other connectors.

In some embodiments, the battery module 400 can also include holes or apertures 450 that allow sound from a speaker to pass through the apertures and enter the interior cavity 140 of the candle body 100. As seen in FIGS. 4-6, the battery module can comprise apertures 450 on the lower portion 420 of the battery module 400. In this manner, the lower portion 420 of the battery module 400, which can serve as a cylindrically shaped speaker housing, can allow sound from the speaker housing to escape into the interior cavity 140 of the candle body 100.

The apertures 450 can connect the relatively small volume directly behind the speaker 500 to the relatively larger volume of the interior cavity 140 of the candle body 100. In some embodiments, the apertures 400 are large enough that they do not significantly reduce the coupling between the small volume behind the speaker 500 and the larger interior volume of the interior cavity 140. Moreover, in some embodiments, the interior of the candle can be used as a tuned resonator, and the apertures can be large enough that they do not significantly affect the resonant frequency of the speaker/candle body volume combination. For example, in some embodiments, the apertures 450 can be large enough that they do not change the resonant frequency of the speaker 500 by more than 10% (or 15%, or 20%, for example) when the speaker 500 is not inside the candle.

The apertures 450 can be of a sufficient size to allow enough sound waves from the rear of the speaker to enter into the interior cavity 140 without substantially reducing sound quality. In some embodiments, the size of the apertures 450 can vary depending on the size of the electronic candle 10. For example, in some embodiments, an electronic candle 10 that is 3 inches in diameter by six inches tall may utilize a battery module 400 having apertures that are can be about 32-45 $mm^2$. More specifically, the apertures 450 can be about 8-9 mm wide and about 4-5 mm high. Even more specifically, in some embodiments, the apertures 450 can be about 4.6 mm by 8.9 mm, for a total area of about 40.94 $mm^2$. Depending on the size and shape of the candle, the battery module 400 can comprise a variety of numbers of apertures 450. For example, in some embodiments, the battery module 400 can comprise just one aperture 450, or it can comprise two, three, four, five or six apertures 450 spaced evenly around the circumference of the lower portion 420 of the battery module 400. The total size and area of the apertures 450 can be sufficient to allow sound from the rear of the speaker 500 to enter into the interior cavity 140 of the candle body 100 relatively unobstructed.

In some embodiments, the apertures can be located on other portions of the power unit 200, depending on the shape and configuration of the power unit 200. For example, in some embodiments, the battery module 400 may not comprise a lower portion 420 defining a speaker housing. In such an embodiment, the power unit 200 can comprise apertures 450 on the base cap module 600, where the apertures 450 are configured to allow sound to pass into the interior cavity 140 of the candle body 100.

The battery module 400 can be removable from the interior cavity 140 of the candle body 100, so that a user can install, replace, repair, or otherwise access the batteries 412 of the electronic candle 10. For example, in some embodiments, the entire power unit 200 can be removable from and installable in the electronic candle 10. In this manner, a user can access the batteries 412 of the battery module 400 when the power unit 200 is removed. In other embodiments, the battery module 400 can be removable separate from the power unit 200.

Figure 7:
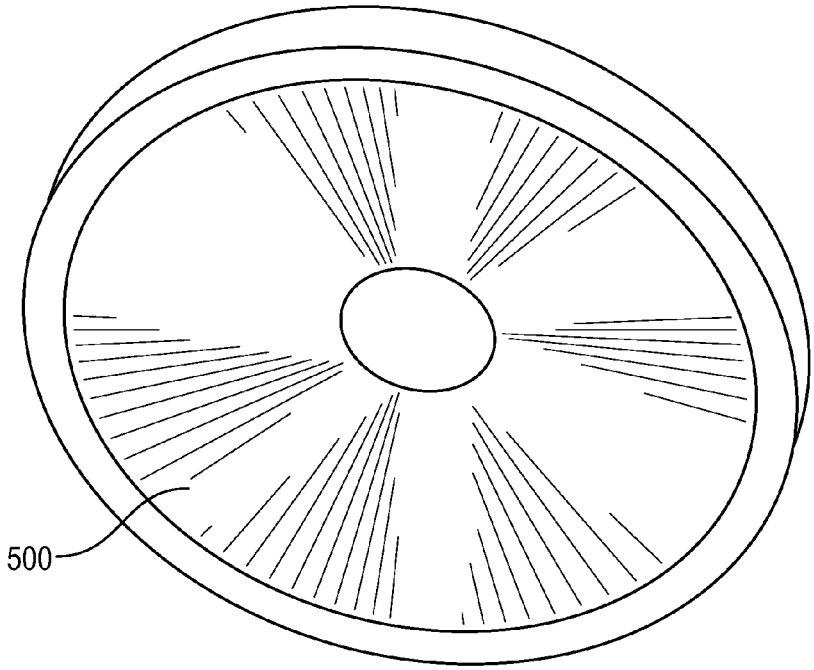
FIG. 7 shows a speaker for use with an electronic candle in accordance with at least one embodiment of the present technology.

The power unit 200 can also comprise a speaker 500 for generating sound. FIG. 7 shows an isometric view of a speaker 500 for use with an electronic candle 10. In operation, the speaker 500 can be positioned in the power unit 200 beneath the battery module 400, for example, and configured to project sound primarily downwards, toward the lower portion 120 of the candle body 100 or towards the base cap module 600. In some embodiments, the speaker is of a size and shape to fit within a space defined by a lower portion 420 of the battery module. Additionally and/or alternatively, the speaker 500 can be configured to fit within the base cap module 600 of the power unit 200. The speaker 500 can be in electrical connection to the battery module 400, so that electrical power from the batteries 412 is used to operate the speaker 500.

In some embodiments, the speaker 500 can be used to play sound recordings that are obtained or recorded by the electronic candle 10. Additionally and/or alternatively, the speaker 500 can be connected, directly or indirectly, to another sound source, such as a radio antenna (for example, a radio antenna installed in the electronic candle 10), a stereo, an mp3 player or another sound system, and used to produce music or other sounds. For example, the candle 10 may include an input port configured to receive an electronic sound signal from an external source (for example, a stereo or mp3 player, Wi-Fi and/or Bluetooth). A processor or other processing circuitry may receive the electronic sound signal and transmit a corresponding signal to the speaker 500. In this manner, the electronic candle can be used as a speaker configuration, or as a sound source in addition to its utility as an electronic candle.

Figure 8:
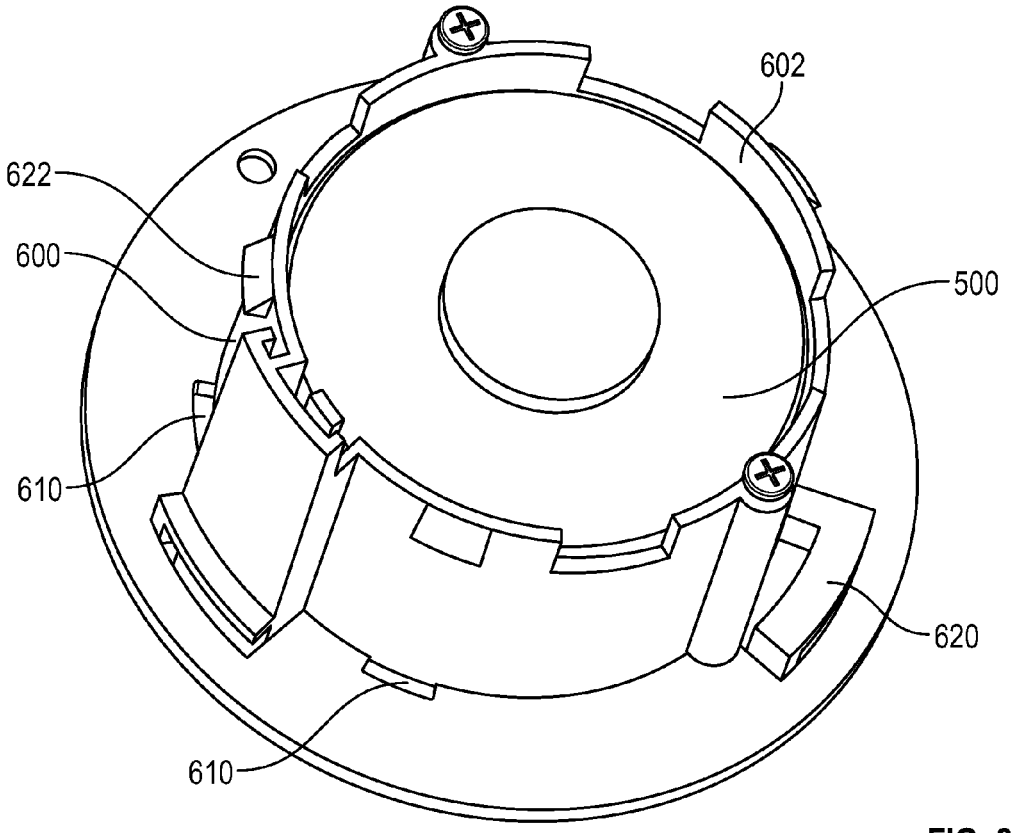
FIG. 8 shows a base cap module with a speaker for use with an electronic candle in accordance with at least one embodiment of the present technology.

FIG. 8 shows an isometric view of the base cap module 600 of the power unit 200. In FIG. 7, the base cap module 600 is shown with a speaker 500 in the base cap module 600. As shown, the speaker 500 can be of a size and shape to fit within an inner cylinder portion 602 of the base cap module 600. In some embodiments, the speaker 500 can fit within the inner cylinder portion 602, and within the space defined by the lower portion 420 of the battery module 400. In this manner the speaker 500 can be positioned between the battery 400 module and the base cap module 600 so that the electronic candle 10 projects sound primarily downwardly, or toward the lower portion 120 of the candle body 100. For example, the speaker 500 can be arranged to project sound downwards, or away from the electronic light source 300.

The base cap module can comprise one or more apertures (for example, apertures 450) which can be slots, holes, groves, etc. that allow sound projected by the speaker 500 to reenter the internal cavity 140 of the electronic candle 10. In this manner, the candle body 100 can provide isolation of the front and rear waves emanating from the speaker and/or serve as a resonating box that amplifies the sound generated and projected by the speaker 500 and/or the electronic candle 10.

The base cap module 600 also comprises mating components 620 that can be used to connect to the candle body 100, for example, to the mounting ring 130. These components can be, for example, bayonet connectors that provide for a twist and fit connection. For example, the mating components 620 can be designed to fit within corresponding connectors on the candle body 100 (for example, the mounting ring 130), and then adapted to be twistable, or rotatable, in a clockwise or counter-clockwise direction so that the base cap module 600 can be fixed in place. The base cap module can also be twisted or rotated to disengage the base cap module 600 so that it can be removed from the candle body 100. For example, the base cap module 600 can be disconnected from the candle body 100 so that the power unit 200 can be removed and accessed by a user. In this way, the electronic candle 10 can be designed, configured, or adapted so that a user can remove and access the battery module 400 without affecting the general position of the speaker 500 in the power unit 200 relative to the battery module 400 and the base cap module 200.

The base cap module 600 can also comprise one or more speaker holes 610, which can be used to deliver sound external to the electronic candle 10. For example, speaker holes 610 can be a part of a speaker screen 640 on a bottom surface of the base cap module 600.

Figure 9:
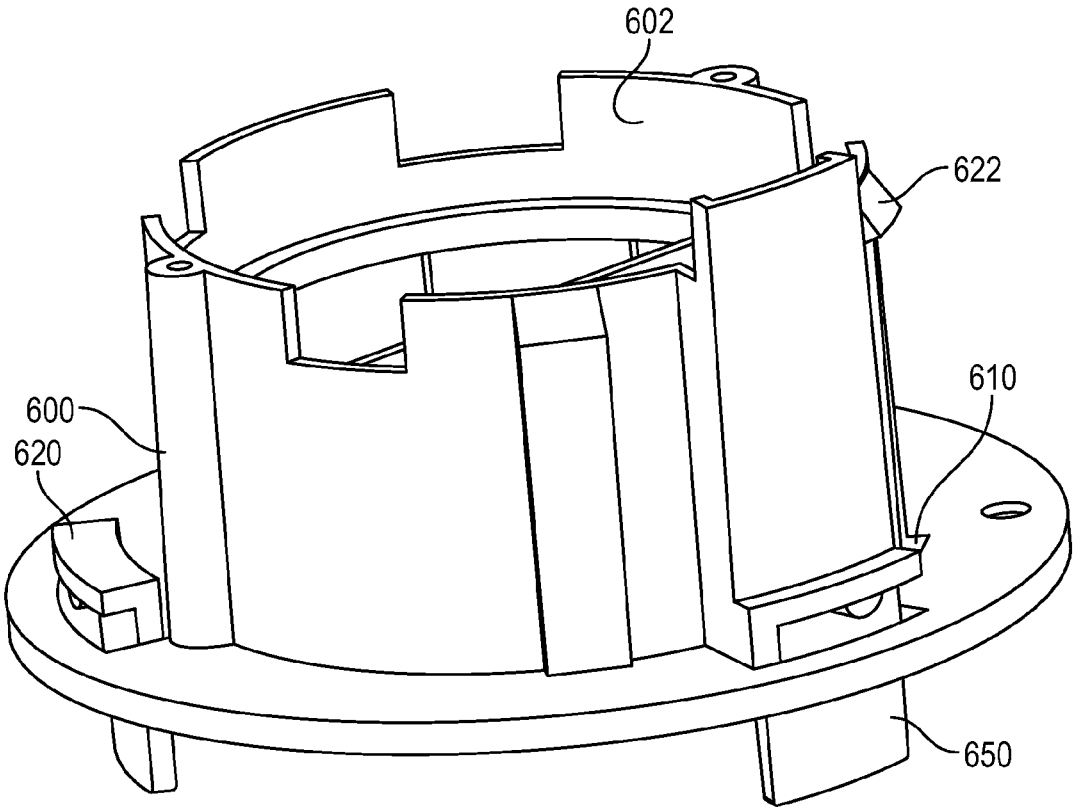
FIG. 9 shows an isometric view of a base cap module for use with an electronic candle in accordance with at least one embodiment of the present technology.

FIG. 9 shows another isometric view of the base cap module 600 without the speaker 500 in place. As shown, the base cap module base stands 650, which can be used to elevate the electronic candle 10 above the resting surface. The elevation provided by the base stands 650 can achieve multiple benefits. For example, the base stands 650 can elevate the electronic candle so that the sound generated by the speaker is projected into a space between the electronic candle 10 and the resting surface, rather than being projected directly onto a resting surface. This can help the electronic candle to produce an unobstructed and/or higher quality sound, for example. Additionally and/or alternatively, the base stands 650 can allow room for a bottom surface of the base cap module 600 to contain various buttons, knobs, lights, displays, or other three-dimensional functional equipment that render the bottom surface of the base cap module 650 uneven. Accordingly, the base stands 650 can provide an even resting surface for an electronic candle 10, notwithstanding the various features on the bottom surface of the electronic candle 10.

Figure 10:
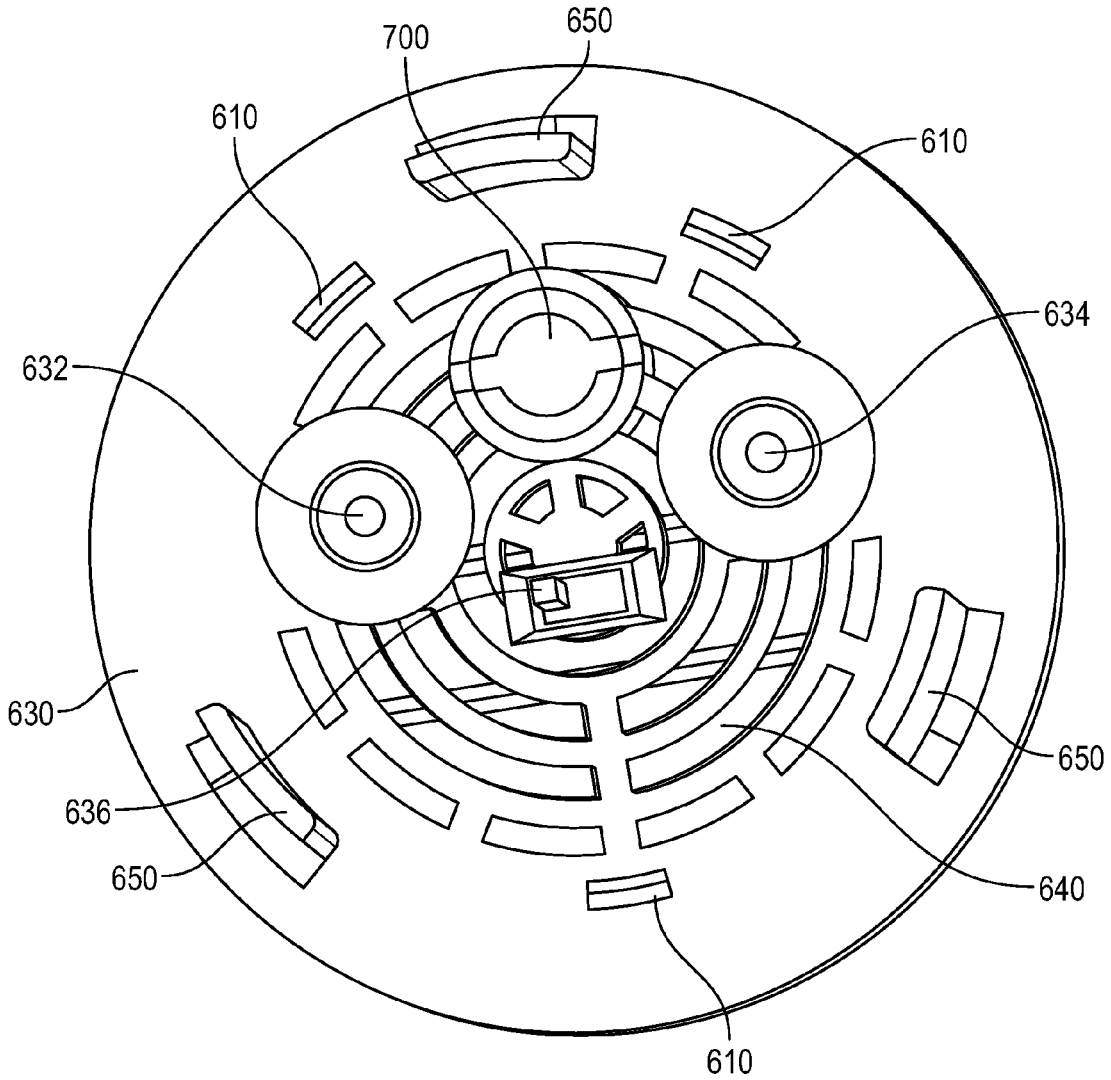
FIG. 10 shows an interface of a base cap module for use with an electronic candle in accordance with at least one embodiment of the present technology.

FIG. 10 shows a bottom surface, or an interface 630 (for example, a user interface), of the base cap module 600. The interface 630 can comprise a speaker screen 640 that has a variety of holes 610, slots, groves, or openings that facilitate the delivery of sound out of the electronic candle 10. In certain embodiments, the interface can comprise one or more knobs, switches, buttons, controls, or other features that allows a user to operate various functionality of the electronic candle. For example, the interface 630 can comprise a switch 636, which can be an on/off switch, for example. In some embodiments, switch 636 can provide more than two positions, each position allowing a user to toggle the electronic candle 10 between various other states. For example, the switch 636 can comprise an on position, an off position, a standby position, a timer position, sound on and off positions, and/or recording on and off positions. Alternatively, more than one switch may be implemented to control operations of the candle 10. For example, one switch may enable/disable the speaker while another switch may enable/disable the light source.

The interface 630 can also comprise a sound input device such as a microphone 800, which can be used to record a voice or other sound, and re-played via the speaker 500. The microphone 800 can be located on the power unit 200, or otherwise positioned in the interior cavity 140 of the candle body 100. The microphone 800 can be operated, for example, via one or more buttons or knobs on the interface 630. For example, the interface 630 can comprise a recording button 632 and a playback button 634. In some embodiments, a user can record sounds by pressing and/or holding the record button 632, and then play back that sound, for example, by pressing the playback button 634. In some aspects, the buttons 632 and 634 can be used to execute other functionality, such as scanning radio stations, connecting to a wireless signal, and/or adjusting the volume, of the candle speaker 500. For example, the electronic candle 10 can have a processor and/or circuitry comprising a wireless network adaptor, for example. The electronic candle 10 and/or the processor can then communicate with other wireless devices, such as an mp3 player, a computer, a cell phone, a tablet, a computer, a wireless network router, or other device via the wireless network adaptor. For example, the electronic candle 10 and/or the processor can comprise a bluetooth adaptor that enables communication with other devices (for example, cell phones) equipped with Bluetooth functionality. In this manner, the wireless devices can transmit signals such as audio files or other data wirelessly to the electronic candle, such that the electronic candle can process and play the audio files via the speaker 500, for example.

Figure 11:
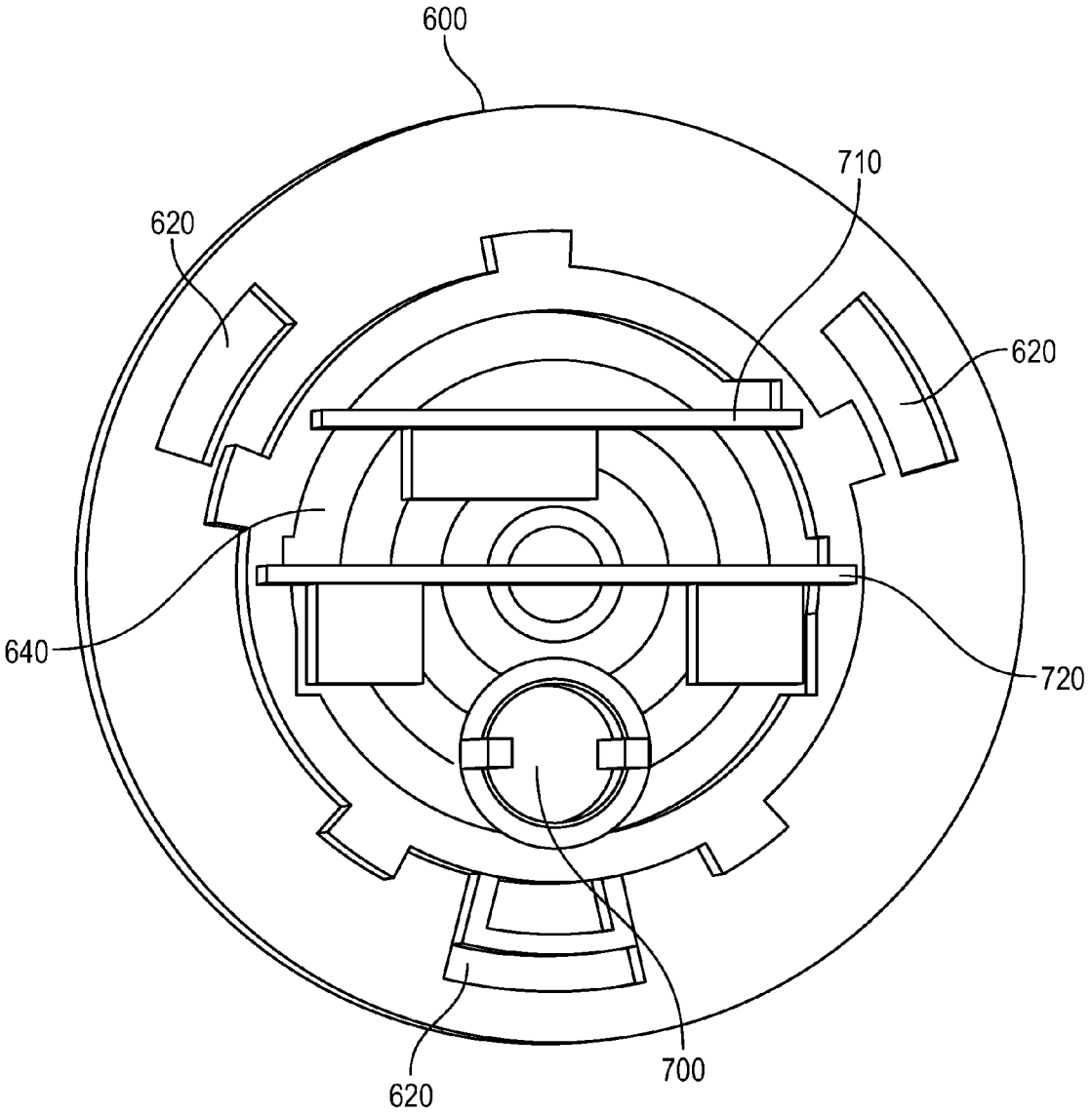
FIG. 11 shows a recording and sound playback system for use with an electronic candle in accordance with at least one embodiment of the present technology.

The various functionality of the electronic candle 10 can be controlled and/or managed via various circuits, circuit boards, processors, or control modules located within the electronic candle 10. In some embodiments, the base cap module 600 can comprise at least one circuit, for example, a circuit printed on a printed circuit board ("PCB"), for managing sound recorded and played by the electronic candle. FIG. 11 depicts a top view of a base cap module 600 whereby having two multiple circuits on PCBs (710 and 720). For example, the electronic candle 10 can include a recording circuit on a PCB 720 that can be used to manage voice or other recordings that can be obtained via the microphone 800. The recording circuit PCB 720 can include or be connected to a memory (see, for example, FIG. 12, no. 750), which can be capable of recording and storing audio files for playback on the speaker 500 of the electronic candle 10.

In some embodiments, the recording circuit 720 manages playback of digital audio files. The playback can be controlled by a user, for example, via the interface 630 of the base cap module 600. Though FIG. 10 shows an embodiment where the recording circuit 720 is located within the base cap module 600, in other embodiments the recording circuit 720 can be positioned in other locations on the power unit 200, or within the electronic candle 10. For example, the recording circuit PCB 720 can be located in or on the battery module 400, or under the battery module 400, either above or below the speaker 500. For example, FIG. 4 depicts an embodiment where the recording circuit is on a PCB 720 located on the battery module 400 of the power unit 200.

The electronic candle 10 can also comprise a candle circuit, which can be, for example, on a PCB 710 located in the base cap module 600 (for example, as shown in FIGS. 4 and 11), on the battery module 400, or in another location depending on the shape and operation of the electronic candle 10. The candle circuit can control the electronic light source 300 of the electronic candle 10. In some embodiments, the candle circuit can be used to execute flickering programs that controls the appearance and operation of the electronic light source 300. For example, the candle circuit can be used to execute a flickering program designed to make the electronic light source 300 appear as if it were an actual flame. In some embodiments, the candle circuit can be located in, or as a part of the electronic light source 300, for example, within a casing of an LED light source 300.

In some embodiments, the microphone 800, the candle circuit PCB 710 and/or the recording circuit PCB 720 are positioned between the battery module 400 and the base cap module 600, and are in electrical connection with the battery module. In some aspects of the present technology, the candle circuit PCB 710 can communicate with, and operate in connection with the recording circuit PCB 720.

In some embodiments of the present technology, the speaker 500 can be placed within the candle body 100 with separation between the speaker 500 and the speaker screen 640. In this manner, the various features and/or functionality of the interface 630 (for example, the microphone 800, the buttons 632, and 634, and the switch 636) can be placed in the center of the interface 630, rather than on a portion outside of the speaker 500. Accordingly, a larger speaker can be used in the candle body, thereby providing higher sound quality, and an improved low-end frequency response. For example, where a speaker is mounted directly to the bottom of a candle screen, the various functionality of the electronic candle (for example, switches, pushbuttons, microphones) would be mounted on the candle screen outside of the perimeter of the speaker. Accordingly, in such an embodiment, the candle speaker would need to be small enough to allow for these various components and functionality to be mounted on the candle. By providing the speaker 500 in the candle body 100 with separation between the speaker 500 and the speaker screen 640, the speaker can be much larger, having a diameter up to the inner diameter of the candle body 100. Moreover, providing space between the speaker 500 and the speaker screen 640 allows the candle circuit PCB 710, the recording circuit PCB 720, and other circuits and/or PCB's to be placed within the speaker perimeter inside the candle body. In this manner, the number of connecting wires necessary to control the candle can be reduce and/or simplified.

Figure 12:
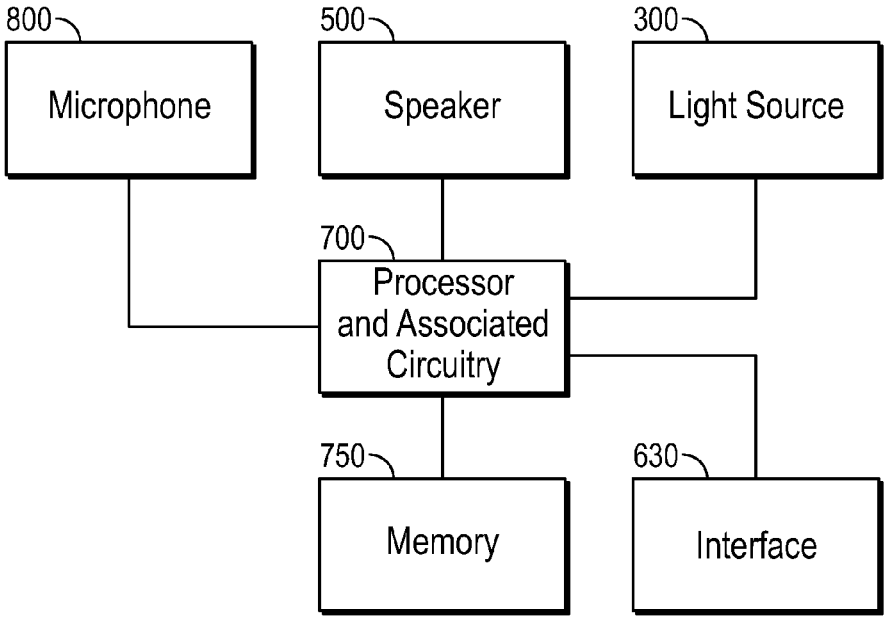
FIG. 12 is a block diagram showing electrical connections among various components of an electronic candle in accordance with at least one embodiment of the present technology.

FIG. 12 provides a block diagram showing electrical components of an electronic candle 10 according to embodiments of the present technology. A processor 700 (which can also include associated circuitry such as sound input conditioning circuitry, memory interface circuitry, interface signal conditioning circuitry, speaker driving and amplification circuitry, or the like) can be electrically connected with a microphone 800, speaker 500, light source 300, interface 630, and/or memory 750. The processor 700 can receive signals from the microphone 800 and store them in the memory 750 and/or provide corresponding signals to the speaker. The processor 700 can also receive sound signals from another source (for example, from an mp3 player or from an antenna) and store the signals in the memory or send corresponding signals to the speaker.

The processor 700 can receive signals from the interface 630 and responsively control functions of the electronic candle 10. For example, the processor 700 can play sound on speaker 500, record sound through microphone 800, erase memory, control the light source 300 (for example, the on/off of the light, the flickering of the light, the color of the light, etc.), control or adjust the volume, select a sound input source, restore default sound, select from preprogrammed sounds, and/or execute a timer, scan radio frequencies.

A power supply (not shown in FIG. 12, but which could be, for example, batteries 412 stored in battery module 400) can provide power to one or more of the components as needed. For example, the power supply can provide power directly and/or indirectly to processor 700, microphone 800, memory 750, speaker 500, light source 300 and/or the interface 630. In some embodiments, the interface 630 may include switches that connect or disconnect the power supply from a given component. For example, the interface 630 may include a switch that controls whether power is supplied to the light source 300. In such an instance, the light source 300 may not be connected to the processor 700 and associated circuitry and may include a separate flickering circuit (for example, flickering circuitry within an LED). In some embodiments, the processor 700 and associated circuitry can control the light source flickering in a manner that is based on the beat, melody, pitch, volume, or other features of the sound generated by the speaker 500.

In some embodiments, the processor 700 and associated circuitry can be provided on a PCB. For example, in some embodiments, the processor 700 and associated circuitry can be provided on the recording circuit PCB 720, the candle circuit PCB 710, or on another PCB that can comprise both the recording circuit and the candle circuit, and can be used to perform and manage all of the functionality of the electronic candle 10. The general circuitry can be, for example, a PCB with multiple circuits printed or integrated on the PCB. Additionally and/or alternatively, the general circuitry 700 can be provided in multiple locations throughout the candle, for example, on multiple PCB's with each PCB comprising a different circuit for executing separate functionality.

In operation, the present technology can provide a battery module 400 that can provide electrical power to the electronic light source 300, without obstructing the light generated by the electronic candle. Moreover, the battery module 400 can also provide electrical power to the speaker 500 without obstructing sound generated by the electronic candle.

Figure 13:
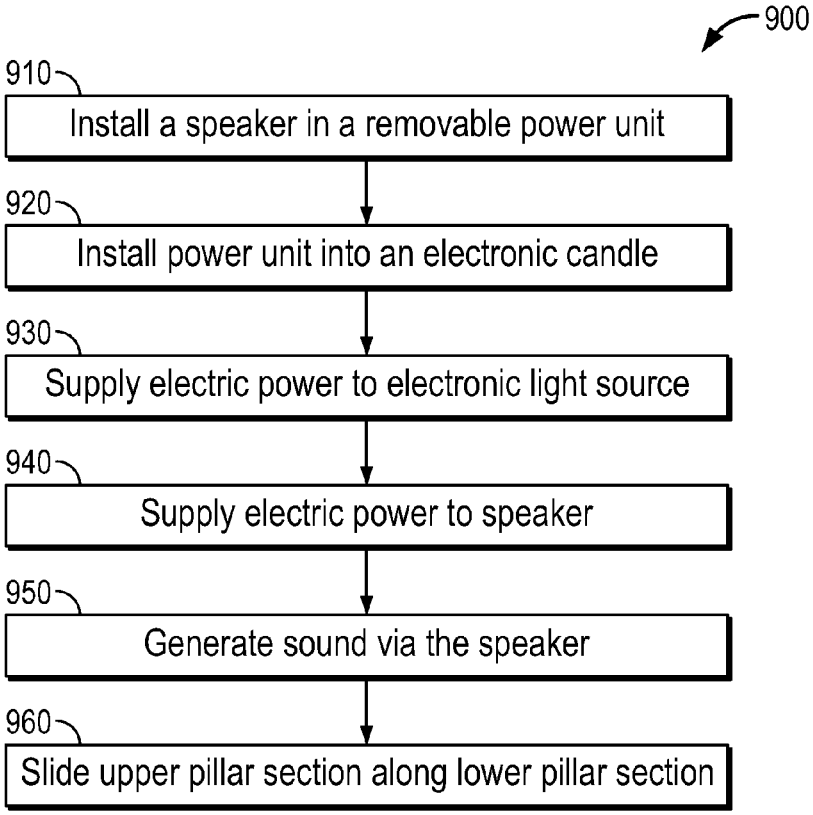
FIG. 13 is a flow diagram of a method for generating sound with an electronic candle in accordance with at least one embodiment of the present technology.

The present disclosure also includes methods for generating sound inside of an electronic candle. FIG. 13 is a flow diagram of a method 900 for generating sound with a battery powered electronic candle. At step 910 a speaker is positioned within in a removable power unit. For example, the power unit can comprise a battery module and a base cap module, and the speaker can be positioned or installed between the battery module and the base cap module so as to direct sound primarily downwards toward the base cap module. In some embodiments the power unit comprises one or more holes or apertures that allow sound to travel through the holes.

At step 920, the power unit is installed or positioned into a body of an electronic candle. The candle body can be hollow and have an interior cavity, for example, as described and depicted herein in reference to candle body 100 of FIGS. 1 and 2. The power unit can be installed or positioned in a manner that allows the power unit to be readily and easily uninstalled from the electronic candle.

At step 930, the power unit supplies electrical power to an electronic light source. For example, an LED light can be positioned on the power unit, and the battery module on the power unit can supply electrical power to the light from batteries installed in the battery module.

At step 940, the power unit supplies electrical power to a speaker. For example, the speaker can be electrically connected to the battery module so that the battery module can supply electrical power to the speaker from batteries installed in the battery module.

At step 950, the electronic candle generates sound via the speaker. For example, the speaker can play music, voice recordings, or other sounds and noises. In some embodiments, the speaker produces sounds stored on a circuit, a PCB, or a memory device located within the electronic candle. Additionally and/or alternatively, the speaker can produce sound received via an antenna (for example a radio antenna), or via a wired or wireless connection. In some embodiments, the candle can include an antenna, and the electronic candle can be used as a radio, for example. In still further embodiments, the electronic candle can be connected (for example, wirelessly via a Bluetooth or other network connection) to an audio source, such as an mp3 player or sound system, and used to play music or other pre-recorded sounds.

At step 960, sound is directed from the speaker back into the cavity of the candle body, for example, through apertures in the power unit. In this manner, the front and rear sound waves from the speaker are isolated and/or the candle body can resonate or amplify the sound produced by the speaker. Accordingly, the method 800 can be used to provide an electronic candle that produces a louder, richer, cleaner, and generally more pleasing sound.

The present technology describes systems and methods relating to a battery powered electronic candle with a speaker. Although the primary description of the technology in this disclosure relates, for the most part, to electronic candles, it is hereby noted that the present technology is not exclusively limited to use with electronic candles. For example, the present technology can be implemented in any battery powered, sound producing display device. In particular, the present technology can be employed in any display unit that involves the use of replaceable batteries as a power supply source. For example, the present technology can be used in connection with a variety of display units including, but not limited to, clocks, vases, digital picture displays, radios, bookends, paperweights, statues, sculptures, or other artwork, lamps, flashlights, and/or appliances. Moreover, the display units and/or electronic candles of the present technology can take on a variety of shapes, sizes and configurations. For example, in some embodiments, the display units and/or electronic candles can be in the shape of cylinders, pillars, boxes, tubes or spheres. And in some embodiments, the display units and/or electronic candles can take on ornamental shapes or designs Accordingly, it should be recognized that any reference herein to an electronic candle can be considered a reference to another display unit (for example, any of the aforementioned display units), with any modifications made as necessary to accommodate the utility, functionality, and/or operation of the particular display unit.

The present technology has now been described in such full, clear, concise and exact terms as to enable any person skilled in the art to which it pertains, to practice the same. It is to be understood that the foregoing describes preferred embodiments and examples of the present technology and that modifications may be made therein without departing from the spirit or scope of the invention as set forth in the claims. Moreover, it is also understood that the embodiments shown in the drawings, if any, and as described above are merely for illustrative purposes and not intended to limit the scope of the invention. As used in this description, the singular forms "a," "an," and "the" include plural reference such as "more than one" or "at least one" unless the context clearly dictates otherwise. Further, all references cited herein are incorporated in their entirety.

The invention claimed is:

1. An electronic candle comprising:

a candle body including an interior cavity and a base, wherein the candle body has an opening at the base;

a light source located in an upper region of the interior cavity;

a battery module configured to hold at least one battery and located below the light source; and a speaker below the battery module;

wherein:

the battery module is electrically connected to the light source and the speaker, whereby the at least one battery delivers power to at least one of the light source and the speaker when the at least one battery is held by the battery module; and the speaker is arranged to direct sound primarily downwardly.

2. The electronic candle of claim 1, wherein the light source emits a flickering light when receiving power from the at least one battery.

3. The electronic candle of claim 1, further comprising:

a microphone configured to receive sound and generate signals;

a memory; and a processor configured to receive the signals from the microphone and store the signals in the memory.

4. The electronic candle of claim 1, wherein:

the light source, the battery module, and the speaker are included in a removable unit; and the removable unit is sized to be inserted into and removed from the interior cavity through the opening in the candle body.

5. The electronic candle of claim 4, further comprising:

a microphone configured to receive sound and generate signals;

a memory; and a processor configured to receive the signals from the microphone and store the signals in the memory.

6. The electronic candle of claim 5, further comprising a wireless adaptor configured to wirelessly communicate with at least one other wireless communications device.

7. The electronic candle of claim 6, wherein:

the wireless adaptor is configured to receive audio data from at least one other wireless communications device; and the electronic candle is adapted to process the audio data and to play a resulting sound through the speaker.

8. The electronic candle of claim 4, further comprising a speaker screen below the speaker.

9. The electronic candle of claim 4, wherein the removable unit further includes a plurality of stands extending below the speaker so as to elevate the electronic candle above a resting surface when the removable unit is inserted in the candle body.

10. The electronic candle of claim 4, wherein the removable unit further includes a user interface below the speaker.

11. The electronic candle of claim 10, wherein the user interface includes a switch configured to enable or disable operation of the light source.

12. The electronic candle of claim 10, wherein the user interface includes a switch configured to enable or disable operation of the speaker.

13. The electronic candle of claim 10, wherein the user interface includes a control adjustable to change a volume of the speaker.

14. The electronic candle of claim 1, wherein an upper portion of the candle body comprises a concave portion shaped to emulate a candle that has had a portion of interior candle wax melted away.

15. The electronic candle of claim 14, wherein the light source is located below the concave portion.

* * * * *